US006470541B1

(12) United States Patent
Lerner

(10) Patent No.: US 6,470,541 B1
(45) Date of Patent: Oct. 29, 2002

(54) FABRIC ANCHOR

(76) Inventor: Louis L. Lerner, The Lerner Group, P.O. Box 10601, Chicago, IL (US) 60610-0601

( * ) Notice: Subject to any disclaimer, the term of this patent is extended or adjusted under 35 U.S.C. 154(b) by 0 days.

(21) Appl. No.: 09/836,709

(22) Filed: Apr. 17, 2001

(51) Int. Cl.[7] ..... A44B 9/10

(52) U.S. Cl. ..... 24/706.4; 24/709.3; 24/598.1

(58) Field of Search ..... 24/706.4, 707.7, 24/706.2, 708.4, 708.8, 708.5, 709.5, 709.3, 709.7, 709.1, 710.5, 710.4, 710.9, 711.2, 711.3, 67 P, 67.9, 591.1, 595.1, 598.2

(56) References Cited

U.S. PATENT DOCUMENTS

| | | | | | |
|---|---|---|---|---|---|
| ,837,295 | A | * | 12/1906 | Fisher | 24/598.2 X |
| 901,827 | A | | 10/1908 | Pittman | |
| 1,055,568 | A | * | 3/1913 | Stransky | 24/706.4 |
| 1,114,737 | A | * | 10/1914 | Dieterich | 24/709.7 |
| 1,134,472 | A | | 4/1915 | McConnell | |
| 1,360,794 | A | * | 11/1920 | Ralph | 24/709.3 X |
| 2,227,676 | A | * | 1/1941 | Schwartz et al. | 24/709.5 |
| 2,246,495 | A | | 6/1941 | Alessi et al. | |
| 2,275,984 | A | | 3/1942 | Nitchman | |
| 2,285,051 | A | * | 6/1942 | Pujol | 24/706.4 X |
| 3,296,671 | A | | 1/1967 | Pawlowski | |
| 3,570,076 | A | | 3/1971 | Wagner | |
| 4,044,429 | A | | 8/1977 | Wagner | |
| 4,750,243 | A | * | 6/1988 | Davis | 24/598.1 |
| 5,515,584 | A | | 5/1996 | Adell | |

* cited by examiner

*Primary Examiner*—Robert J. Sandy
(74) *Attorney, Agent, or Firm*—Olson & Hierl, Ltd.

(57) ABSTRACT

Fabric anchor embodiments comprise at least one elongate anchor member having first and second ends with axial fastening features for temporary axial locking engagement. The fabric anchors can be disengaged upon application of sufficient disengaging axial tension. A preferred embodiment is a self-fastening single elongate member. In other preferred embodiments one fabric anchor can fasten to another fabric anchor to provide anchoring for variable fabric thickness or lengths.

29 Claims, 4 Drawing Sheets

FABRIC ANCHOR

TECHNICAL FIELD OF THE INVENTION

This invention relates generally to devices for temporarily anchoring at least two portions of fabric together and more particularly to devices that penetrate the portions of the fabric that are to be anchored.

BACKGROUND OF THE INVENTION

Various devices are known for temporarily anchoring two portions of fabric together, often to close an opening in a garment. Some examples are buttons and button holes, hooks and eyelets, snaps, and zippers. Each of the aforementioned anchoring devices includes a pair of mating members, with each member secured to a respective portion of the fabric in a fixed location. Consequently, the positions of the two portions of the fabric relative to each other, when the fastening devices are mutually engaged, are predetermined.

Some garments are intended to be worn such that two or more portions overlap each other to a varying extent selected by the user, to provide a custom fit, and be temporarily anchored together in the selected position. One example of such a garment is the cloth diaper worn by infants, toddlers, bedridden invalids and the like. Typically, the diaper is folded such that a front portion extends between the legs and up over the pubic region and two opposed side portions wrap about the hips to overlie the front portion at each side. Each of the side portions are desirably anchored to the front portion, and the amount of overlap between the side portions and the front portion is adjusted so that the diaper fits snugly about the waist above the hips so that it will not fall off easily. Typically, the overlapping portions of the diaper are pinned together with so-called safety pins.

Conventionally, a safety pin comprises a single length of wire wound into a single-coil spring at about midlength, leaving two legs extending from the single-coil spring in a V-shape. The single-coil spring tends to splay the legs apart and compression of the two legs toward each other is resisted by the spring. One leg is sharpened to a pin-point at its free end. The other leg has a safety clasp fixed to its free end. The safety clasp is configured to receive and cover the pin-point when the two legs are compressed and fastened together. The pin-pointed leg is secured within the safety clasp by the bias provided by the single-coil spring.

The conventional safety pin described above is used by inserting the pin-point through-one side of the overlapping portions of the garment to the other side, and then re-inserting the pin-point back through both overlapped portions of the garment to emerge on the one side, at a location displaced from the first insertion point. The displacement is a distance less than the distance from the pin-point to the single-coil spring. The pin-point emerging from the garment on the one side is then secured within the safety clasp, with the single-coil spring and the safety clasp both being on the same side of the garment.

One limitation of the conventional safety pin used as described above is that only the pin-pointed leg can be used to penetrate the garment. The fabric of the garment cannot slide past the single-coil spring and can be entangled and torn if it comes in contact with the single-coil spring. Therefore, the amount of garment fabric that can be pinned together is limited by the length of the pin-pointed leg of the pin.

Another limitation of the conventional safety pin is that securement of the pin-pointed leg of the pin by the safety clasp is not always effective. For example, the safety clasp can release the pin-point, if the thickness of the fabric being pinned stresses and deforms the safety clasp. It is also possible for the pin-point to slip out of the safety clasp when the pinned portions of the garment are under strain during the physical activity of the wearer of the pinned garment. Because the single-coil spring tends to splay the legs of the safety pin, should the pin-point slip out of the safety clasp the pin-point will be propelled outwardly under spring force. This presents a distinct hazard to the wearer of the garment because the sharp, spring loaded, pin-point can easily stick and injure the wearer. Such an occurrence is particularly undesirable when the garment is a diaper and the wearer, such as an infant or child, is helpless against possible serious injury.

In view of the above limitations and hazards of the conventional safety pin, there is an ongoing need and desire for a simple fabric anchor that avoids the problems of the foregoing prior art. The present invention provides a fabric anchor that eliminates the need for a spring-loaded pin-point, permits a greater portion of the fabric to be penetrated and anchored, and minimizes the risk of injury to the wearer.

SUMMARY OF THE INVENTION

The present invention involves in one preferred embodiment a self-fastening fabric anchor having at least one flexible elongate anchor member having first and second ends. The first end has an elongate male element extending axially therefrom. The second end has a female element therein. The elongate male element of the anchor is sized to be received axially in a friction fit or, alternatively, an interference fit, within the female element of the anchor member. The fit presents sufficient resistance to fasten the male element in engaging relationship within the female element and retain the male element therein, yet permit the male element to be withdrawn upon application of sufficient disengaging axial tension to overcome the resistance to withdrawal.

In other preferred embodiments, a fabric anchor has first and second ends each sized and configured to axially mate with a second fabric anchor in friction fit engagement or, alternatively, in interference fit engagement.

Some benefits of the present invention over the prior art fabric pinning devices include reducing the risk of injury to the wearer by eliminating the use of a spring-loaded pin-point. Another benefit is that a greater portion of the fabric can be anchored since there is no spring coil to block the length of fabric penetrated. Still another benefit is that the user can tailor the fabric anchor of this invention by mixing and matching anchor members for anchoring variable fabric thicknesses. The inventive fabric anchor is also advantageously simple and inexpensive to manufacture.

Other aspects and advantages of the present invention will be apparent from the description of the preferred embodiments below made with reference to the drawings.

DESCRIPTION OF THE PREFERRED EMBODIMENT

Figure 1:
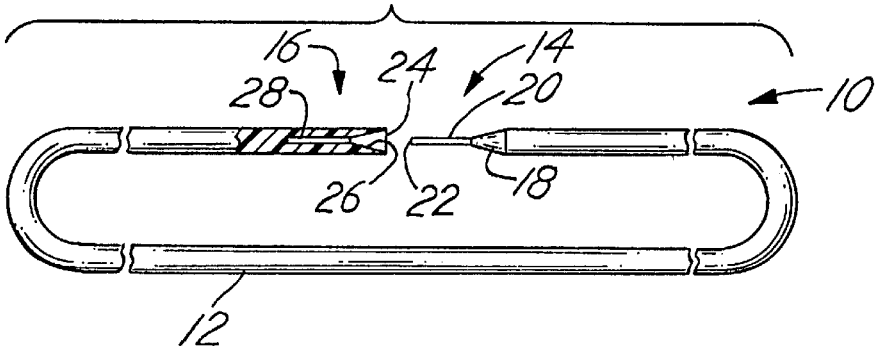
FIG. 1 is a plan view of a first preferred embodiment of a fabric anchor of the present invention, shown partially in section.

FIG. 1 shows a first preferred embodiment of a fabric anchor 10 of the present invention. Fabric anchor 10 has a single member 12 with a male portion 14 and a female portion 16 at opposite ends. Member 12 can comprise a length of extrudable or moldable flexible plastic material, or a metal core covered with plastic material, formed as an elongate solid rod or hollow tube that is bendable back upon itself without breaking or taking a permanent set.

At one end of member 12, male portion 14 has a tapered portion 18 and a straight pin 20 extending axially therefrom. Pin 20 is of reduced diameter relative to member 12 and is preferably constructed of metal, although other materials, including the plastic material of which member 12 is constructed, are contemplated. Tapered portion 18 provides a tapered transition in diameter from pin 20 to member 12. This facilitates penetration of fabric by member 12 following initial penetration with pin 20. Preferably, member 12 is about 1/16 inch in diameter and pin 20 is about 1/32 inch in diameter but is not limited thereto. Pin 20 terminates in a point 22 that is relatively blunt or rounded to reduce risk of injury to the wearer, yet sufficiently sharp to be able to penetrate cloth fabric.

At the opposite end of member 12, female portion 16 terminates in a blunt end 24, in which a conical tapered opening 26 is formed. Tapered opening 26 tapers to communicate with an axial receptacle 28 in member 12, such as an axial bore. Tapered opening 26 tapers at an angle substantially similar to the angle of taper of tapered portion 18. Tapered opening 26 is sized and configured for receiving and accommodating tapered portion 18. Axial receptacle 28 is sized and configured for receiving pin 20 in frictional engagement.

The diameter of pin 20 is selected to be sized relative to axial receptacle 28 such that pin 20 is received in axial receptacle 28 to effect friction locking engagement of portions 14 and 16, thereby making fabric anchor 10 self-fastening. This is effected by the diameter of the axial receptacle 28 being slightly smaller than the diameter of pin 20. Furthermore, female end 16 of member 12 is constructed of a material with sufficient elasticity to expand when pin 20 is inserted in axial receptacle 28, and contract when pin 20 is withdrawn. The elasticity of axial receptacle 28, together with the relative incompressibility of pin 20, causes a compressive force to be exerted by receptacle 28 on pin 20. The static friction between receptacle 28 and pin 20 is thereby increased, resulting in a friction locking engagement.

Pin 20, when inserted into axial receptacle 28, develops sufficient friction with receptacle 28 to retain male portion 14 in engagement with female portion 16. When so engaged, moderate axial tension applied in opposing directions to male portion 14 and female portion 16 will not disengage portions 14 and 16 from one another. Nevertheless, male portion 14 can be withdrawn from female portion 16 by applying sufficient axial tension to overcome the static friction of the frictional engagement, thereby disengaging male and female portions 14 and 16.

Figure 2:
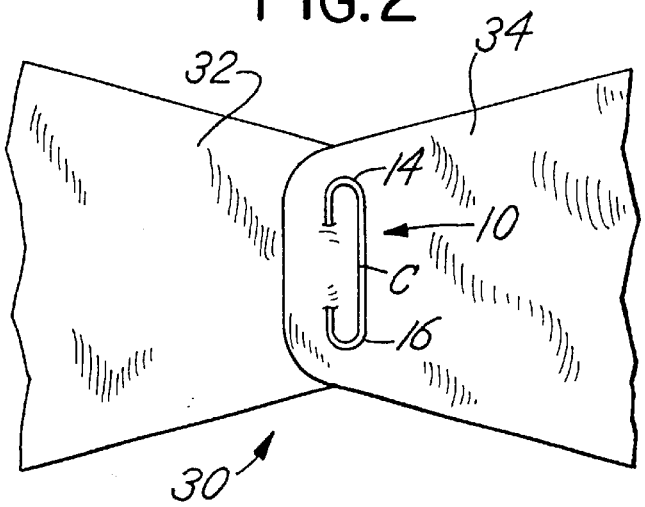
FIG. 2 is a partial view of a garment showing the fabric anchor of FIG. 1 in use, securing at least two portions of fabric together.

In FIG. 2, a non-limiting example of the manner of using fabric anchor 10 of FIG. 1 is shown. Fabric 30, such as a cloth diaper, for example, includes at least two portions such as first portion 32 and second portion 34 that are to be anchored together temporarily. Garments other than diapers, as well as non-garment fabrics, can also be anchored by the inventive fabric anchor. First portion 32 and second portion 34 can be overlapped to close the garment about the waist of an infant, for example.

Portions 32 and 34 can be anchored together by grasping male portion 14 of fabric anchor 10 and inserting the point 22 into portion 34 from the front side, through portion 34 and through portion 32 captured therebelow, so as to emerge from portion 32 on the back side. The angle of approach is then adjusted so that point 22 is re-inserted into and through portion 32 from the backside, through portion 34 thereabove, so as to emerge from portion 34 on the front side, which is the same side that male portion 14 penetrated initially.

The emergent exposed point 22 is then covered by flexing member 12 such that male portion 14 is aligned with female portion 16 and fastening male portion 14 and female portion 16 together by pressing axially such that pin 20 is received in axial receptacle 28. Sufficient axial force is applied to fully seat male portion 14 in female portion 16 such as at location C illustrated in FIG. 2. Elastic compressive force exerted on male portion 14 by female-portion 16 effects a frictional engagement therebetween. The point 22 is covered, further protecting the wearer of the garment from injury, and male portion 14 is fastened to female portion 16, which also helps to keep member 12 from slipping out of the fabric. Nevertheless, should member 12 become unfastened, it will simply fall away rather than spring open like a conventional safety pin, thereby protecting the wearer against being stuck and injured.

It is preferable to insert member 12 in a direction that is substantially perpendicular to the direction of tension in the fabric, so that portions 32 and 34 pull-substantially at right angles to the length of member 12. Consequently, the fabric does not exert a force on fabric anchor 10 that would tend to pull male portion 14 and female portion 16 apart.

When it is desired to open the garment, i.e., separate portion 34 from portion 32 of garment 30, the user can grasp the male and female portions, 14 and 16, respectively, and pull in opposite axial directions with sufficient force to overcome the frictional engagement between male portion 14 and female portion 16 and unfasten portion 14 from portion 16. Thereafter, member 12 can be withdrawn axially from both portions 32 and 34 of the garment 30.

Figure 3:
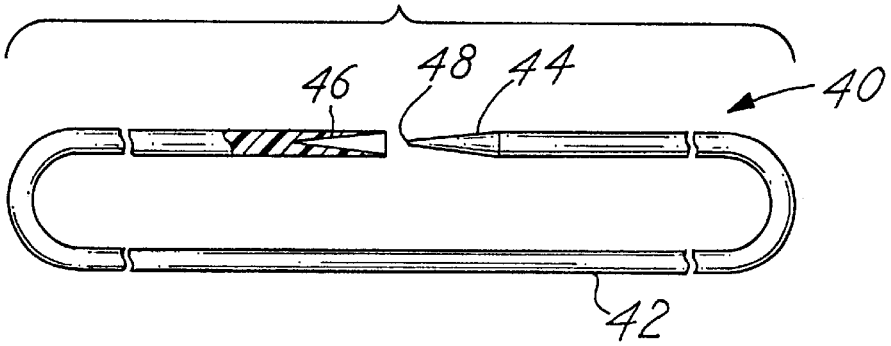
FIG. 3 is a plan view of a second preferred embodiment of a fabric anchor in accordance with the present invention, shown partially in section.

FIG. 3 shows a second preferred embodiment of a fabric anchor 40 of the present invention. Fabric anchor 40 is substantially similar to the first embodiment of fabric anchor 10 of FIG. 1, with particular differences pointed out below. Consequently, the description of common elements will not be repeated except by reference to the corresponding element of the embodiment of fabric anchor 10 shown in FIG. 1. Fabric anchor 40 comprises a single member 42 that corresponds to single member 12 of fabric anchor 10. Elongate tapered portion 44 and its associated point 48 correspond in function to pin 20 and its associated point 22 of fabric anchor 10. Likewise, conically tapered receptacle 46 corresponds in function to axial receptacle 28 of fabric anchor 10.

Somewhat like fabric anchor 10 of FIG. 1, fabric anchor 40 relies upon friction locking engagement of the male and female tapers. The interior surface of tapered receptacle 46 is conically tapered at an angle that is substantially similar to the conical taper of tapered portion 44. The angle of taper is selected to be sufficiently small, with respect to the material of which member 42 is constructed, to provide for wedging, or friction locking engagement, of tapered portion 44 in tapered receptacle 46. Different materials, having differing elasticity and compressibility, will require different angles of taper to effect the wedging action that results in friction locking engagement. In general, the ratio of the length of the taper to the diameter of the fabric anchor is at least about three to one. The manner of using fabric anchor 40 is otherwise similar to the manner of using fabric anchor 10 as described above.

Figure 4:
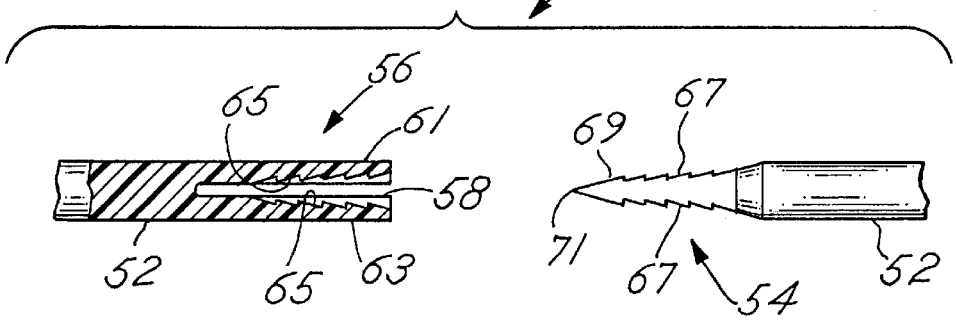
FIG. 4 is an enlarged partial plan view of a third preferred embodiment of a fabric anchor of the present invention, shown partially in section.

FIG. 4 shows an enlarged view of a third preferred embodiment of a fabric anchor 50 of the present invention, which is particularly suitable for anchoring together loose woven, knit or mesh fabrics. Fabric anchor 50 is substantially similar to the first embodiment of fabric anchor 1 of FIG. 1, differing particularly in the configuration of the male and female portions. Consequently, only the male and female portions are shown in FIG. 4, the remainder of fabric anchor 50 being substantially as shown in FIG. 1. Furthermore, the description of common elements will not be repeated except by reference to the corresponding element of the embodiment of fabric anchor 10 shown in FIG. 1. Fabric anchor 50 comprises a single member 52 that corresponds to single member 12 of fabric anchor 10.

Male portion 54 and female portion 56 generally correspond in function to male portion 14 and female portion 16, respectively, of fabric anchor 10. Unlike fabric anchor 10, fabric anchor 50 relies upon mechanical interference to effect locking engagement of the male and female portions 54 and 56, respectively, rather than friction locking engagement. Female portion 56, shown in FIG. 4 in longitudinal cross-section, has a longitudinal slot 58 defined therein that is open at the end and along opposite sides of female portion 56. Cantilevered extensions 61 and 63 of female portion 56 have facing walls that define the slot 58 therebetween. Extensions 61 and 63 include in the respective facing walls a series of axially spaced teeth 65 that generally converge toward member 52. Teeth 65 are shaped and oriented to permit entry of male portion 54 within slot 58, but to resist withdrawal therefrom, as explained further below.

Male portion 54 includes a series of axially spaced teeth 67 that generally converge away from member 52 and terminate in a tapered end 69 having a point 71 that is relatively blunt or rounded to reduce risk of injury to the wearer, yet sufficiently sharp to be threaded through the weave or mesh of the cloth fabric. Tapered end 69 facilitates threading male portion 54 through the fabric. For removal, the anchor is preferably withdrawn by pulling male portion 54 as the lead end away from the fabric to prevent teeth 67 from catching, or inhibiting withdrawal of fabric anchor 50 from, the fabric. Thus, the embodiment of fabric anchor 50 shown in FIG. 4 can be employed to anchor relatively open weave fabrics.

As with fabric anchor 10 of FIG. 1, male portion 54 and female portion 56 can be fastened together in locking engagement by axially aligning male and female portions 54 and 56 and pushing male portion 54 into female portion 56. Extensions 61 and 63 of female portion 56 will be deflected away from each other as male portion 54 enters slot 58. Member 52 preferably is constructed of a flexible and elastic material, such as extrudable or moldable plastic material, permitting extensions 61 and 63 to flex apart and also spring back as male portion 54 becomes seated in female portion 56. Consequently, teeth 65 and teeth 67 interlock such that male and female portions 54 and 56, respectively, cannot be pulled apart easily.

When it is desired to disengage male and female portions 54 and 56 from one another, applying a bending force at the junction therebetween will tend to splay extensions 61 and 63 apart. Teeth 67 will then be released from engagement with teeth 65 and male portion 54 can be withdrawn from female portion 56. The manner of using fabric anchor 50 is otherwise similar to the manner of using fabric anchor 10 as described above.

Figure 5:
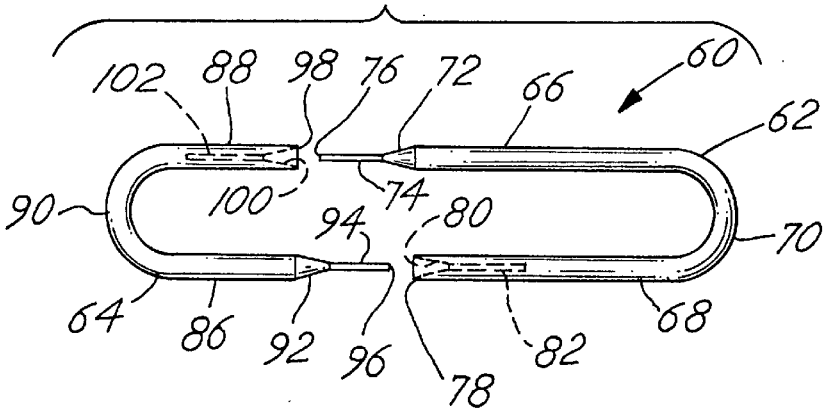
FIG. 5 is a plan exploded view of a fourth preferred embodiment of a fabric anchor of the present invention.

FIG. 5 shows a fourth preferred embodiment of a fabric anchor 60 of the present invention. Fabric anchor 60 includes a first member 62 and a second member 64. First member 62 is illustrated as preferably somewhat longer than second member 64, although members 62 and 64 can be the same length, or member 64 can be longer than member 62. This embodiment affords the user the ability to anchor together various thicknesses of fabric by selecting the appropriate length of members 62 and 64 as needed. The overall length of fabric anchor 60, as well as that of the other embodiments of fabric anchors discussed herein, can be significantly longer than the length of a conventional safety pin. The spring configuration of a conventional safety pin limits its useful length. If the pin-pointed leg is too long, it will not be sufficiently stiff to avoid bending and releasing from the safety clasp. The fabric anchor of the present invention is not so limited and can be made long enough to accommodate fabric of greater total thickness than a conventional safety-pin can accommodate.

First member 62 can comprise a length of extrudable-or moldable plastic material formed as an elongate solid rod or hollow tube that has been bent or molded into a substantially stiff, shape-retaining U-shape to include a first leg 66 and a second leg 68 that are substantially parallel to each other in substantially the same plane. Legs 66 and 68 are connected by an arcuately curved portion 70.

The opposite ends of first member 62 are of opposite gender, leg 66 having a male end and leg 68 having a female end. Leg 66 has a tapered portion 72 and a straight metal pin 74 extending axially therefrom. Pin 74 is of reduced diameter relative to leg 66, and tapered portion 72 provides a tapered transition in diameter from pin 74 to leg 66. This facilitates penetration of a garment by leg 66 following initial penetration with pin 74. Pin 74 terminates in a point 76. Point 76 preferably is relatively blunt and rounded to reduce the risk of injury to the wearer, yet is sufficiently sharp to be able to penetrate cloth fabric.

Leg 68 terminates in a blunt end 78 in which a conical tapered opening 80 is formed. Tapered opening 80 tapers to communicate with an axial receptacle 82 in leg 68 that has n inner diameter slightly smaller than the diameter of pin 76 of leg 66. Tapered opening 78 tapers at an angle substantially similar to the angle of taper of tapered portion 72. Tapered opening 78 is for receiving and accommodating a tapered portion similar to tapered portion 72, but associated with second member 64. Axial receptacle 82 is for receiving a pin similar to pin 74, but associated with second member 64, in frictional engagement, as described further below.

Second member 64, similarly to first member 62, likewise can comprise a length of extrudable or moldable plastic material formed as-an elongate solid rod or hollow tube that has been bent or molded into a substantially stiff, shape-retaining U-shape to include a first leg 86 and a second leg 88 that are substantially parallel to each other in substantially the same plane. Legs 86 and 88 are connected by an arcuately curved portion 90. Like first member 62, the opposite ends of second member 64 are of opposite gender, leg 86 having a male end and leg 88 having a female end.

Leg 86 has a tapered portion 92 and a straight metal pin 94 extending axially therefrom. Pin 94 is of reduced diameter relative to leg 86, and tapered portion 92 provides a tapered transition in diameter from pin 94 to leg 86. This facilitates penetration of a garment by leg 86 following initial penetration with pin 94, should the user desire to penetrate the fabric with second member 64 instead of or in addition to first member 62. Pin 94 terminates in a point 96. Point 96 preferably is sufficiently blunt and rounded to reduce the risk of injury to the wearer, yet is sufficiently sharp to be able to penetrate cloth fabric.

Leg 88 terminates in a blunt end 98 having a conical tapered opening 100 defined therein. Tapered opening 100 tapers to communicate with an axial receptacle 102 in leg 88 that has in inner diameter slightly smaller than the diameter of pin 74 of first member 62. Tapered opening 100 tapers at an angle substantially similar to the angle of taper of tapered portion 72 of first member 62. Tapered opening 100 is for receiving and accommodating tapered portion 72 of first member 62. Axial receptacle 102 is for receiving pin 74 of first member 62 in frictional engagement, as described above with respect to first member 62.

The diameter of pins 74 and 94 are selected to be sized relative to axial receptacles 82 and 102, respectively, such that pins 74 and 94 are received in axial receptacles 82 and 102 to effect friction locking engagement of first member 62 and second member 64. This is effected by the diameter of axial receptacles 82 and 102 being slightly smaller than the diameter of pins 74 and 94. Furthermore, legs 66, 68, 86 and 88 are constructed of a material with sufficient elasticity to expand when pins 74 and 94 are inserted, and contract when pins 74 and 94 are withdrawn.

Pin 74, when inserted into axial receptacle 102, and pin 94, when inserted into axial receptacle 82, develop sufficient friction with receptacles 82 and 102 to retain first member 62 in engagement with second member 64. When so engaged, moderate axial tension applied in opposing directions to first member 62 and second member 64 will not disengage members 62 and 64 from each other. On the other hand, first member 62 can be withdrawn from second member 64 by applying sufficient axial tension to overcome the frictional engagement.

Figure 6:
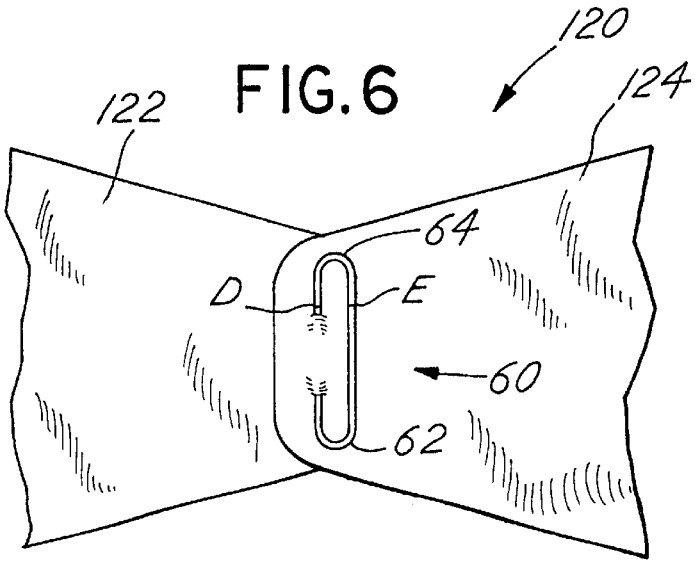
FIG. 6 is a partial view of a garment showing the fabric anchor of FIG. 5 in use, securing at least two portions of fabric together.

FIG. 6 shows a non-limiting example of the manner of using the fabric anchor of FIG. 5. A thick garment 120 is illustrated, as a thick cloth adult diaper, for example, which includes at least two portions such as first portion 122 and second overlapping portion 124 that are to be anchored together temporarily. First portion 122 and second portion 124 are overlapped to close the garment about the waist of an invalid adult, for example. Portions 122 and 124 can be anchored together by first placing the female end of member 62 in locking relationship with the male end of member 64 as illustrated by point E of FIG. 6 and then grasping first member 62 and inserting the point 76 into portion 124 from the front side, through portion 124 and through portion 122 therebelow, so as to emerge from portion 122 on the back side. The angle of approach is then adjusted so that point 76 is reinserted into portion 122 from the backside, through-portion 122 and through portion 124 thereabove, so as to emerge from portion 124 on the front side, which is the same side that member 62 penetrated initially. The exposed point 76 is then covered by aligning the female end of second member 64 with the male end of first member 62 and fastening members 62 and 64 together at point D of FIG. 6 by pressing axially such that pins 74 and 94 are received in axial receptacles 102 and 82, respectively.

Alternatively, first member 62 can be inserted as previously described, and then aligned in mating relationship with the second member 64 and sufficient axial force applied to effect a frictional engagement between member 62 and member 64 at points D and E of FIG. 6. The points 76 and 96 are thereby covered, protecting the wearer of the garment from injury, and member 64 is fastened to member 62, which keeps member 62 from slipping out of the fabric. Nevertheless, should member 62 become unfastened, it will simply fall away rather than spring open like a conventional safety pin, thereby protecting the wearer against being stuck and injured.

It is preferable to insert the fabric anchor in a direction that is substantially perpendicular to the direction of tension in the fabric portions to be anchored, so that portions 122 and 124 pull substantially at right angles to the length of legs 66 and 88 of members 62 and 64, respectively. Consequently, the garment does not exert a force on fabric anchor 60 that would tend to pull members 62 and 64 apart. When it is desired to open the garment, i.e., separate portion 124 from portion 122 of garment 12, the user can grasp the arcuate portions 70 and 90, respectively, of members 62 and 64 and pull in opposite axial directions with sufficient force to overcome the frictional engagement between member 62 and member 64 and remove member 64 from member 62. Thereafter, member 62 can be withdrawn axially from both portions 122 and 124 of the garment 120.

Figure 7:
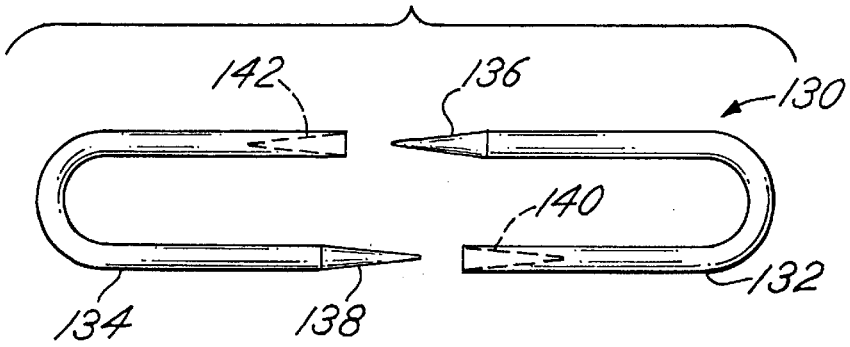
FIG. 7 is a plan exploded view of a fifth preferred embodiment of a fabric anchor in accordance with the present invention.

FIG. 7 shows a fifth embodiment of a fabric anchor 130 that is substantially similar to the embodiment of FIG. 5, with particular differences pointed out below. Consequently, the description of common elements will not be repeated except by reference to the corresponding element of the embodiment of FIG. 5. Fabric anchor 130 comprises a first member 132 and a second member 134 that correspond to first members 62 and 64 of fabric anchor 60. Elongate tapered portions 136 and 138 correspond in function to pins 74 and 94 of fabric anchor 60. Likewise, tapered receptacles 140 and 142 correspond in function to axial receptacles 82 and 102 of fabric anchor 60.

Somewhat like fabric anchor 10 of FIG. 1, fabric anchor 130 relies upon friction locking engagement of male and female tapers. The interior surface of tapered receptacles 140 and 142 are conically tapered at an angle that is substantially similar to the conical taper of tapered portions 136 and 138. The angle of taper is selected to be sufficiently small, with respect to the material of which first member 132 and second member 134 are constructed, to provide for friction locking engagement of first member 132 and second member 134. The manner of using fabric anchor 130 is otherwise similar to the manner of using fabric anchor 62 as described above.

Figure 8:
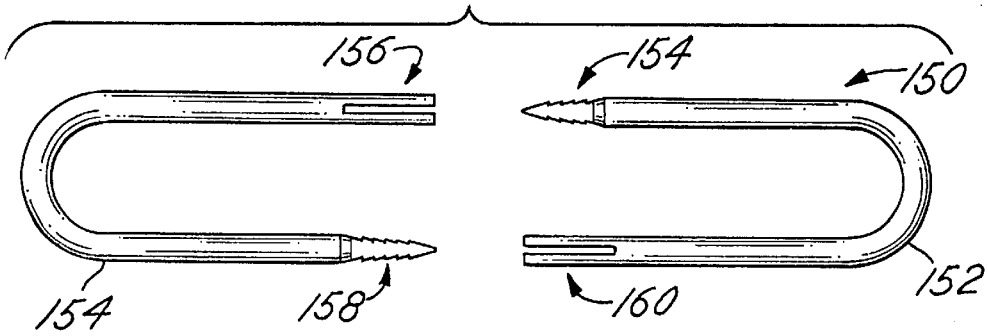
FIG. 8 is a plan exploded view of a sixth preferred embodiment of a fabric anchor of the present invention.

FIG. 8 shows a sixth preferred embodiment of a fabric anchor 150 that is substantially similar to the embodiment of FIG. 5, differing particularly in the configuration of the male and female portions, which are substantially similar to the male and female portions of the embodiment of FIG. 4. Consequently, the description of common elements will not be repeated except by reference to the corresponding element of the embodiments of FIGS. 4 and 5.

Fabric anchor 150 comprises a first member 152 and a second member 154 that correspond to first members 62 and 64 of fabric anchor 60 of FIG. 5. Male portion 154 and female portion 156 generally correspond in function to pin 74 and axial receptacle 102 of fabric anchor 60. Likewise, male portion 158 and female portion 160 generally correspond in function to pin 94 and axial receptacle 82 of fabric anchor 60. The configuration and manner of locking of male portions 154 and 158 and female portions 156 and 160 correspond to that of male portion 54 and female portion 56, respectively, of fabric anchor 50 of FIG. 4. The manner of using fabric anchor 150 is substantially similar to the manner of using fabric anchor 60 as described above, with the exception that the male and female portions are fastened together and disengaged similarly to the male and female portions of fabric anchor 50 of FIG. 4.

The fabric anchors 60 of FIG. 5, 130 of FIG. 7, and 150 of FIG. 8, are particularly suitable for use in anchoring non-garment fabrics, especially stacked fabric swatches and the like where the portions to be anchored can vary in thickness or where variable layers of fabric are being anchored. These fabric anchors offer the user the ability to fasten at least two or more fabric anchors of equal or unequal lengths to accommodate variable thicknesses of fabrics.

For example, in one use aspect, the female end of a first elongate member can be first fastened to the male end of a second elongate member. The free male end of the first elongate member can then be inserted into the fabric portions to be anchored together, as previously described for fabric anchor 10 of FIGS. 1 and 2, and placed in locking engagement with the free female end of the second elongate member. In another use aspect, the male end of one elongate member can be inserted into the fabric portion as described for fabric anchor 10 and then the male end and female end of a second member are then axially mated with the appropriate female end and male end of the first elongate member.

Figure 12:
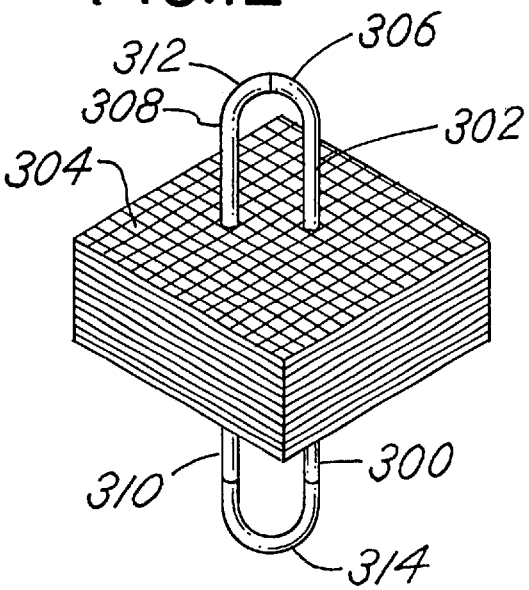
FIG. 12 is a perspective view of multiple fabric anchors, three in number, interconnected and used to anchor together a stack of fabric.
Figure 13:
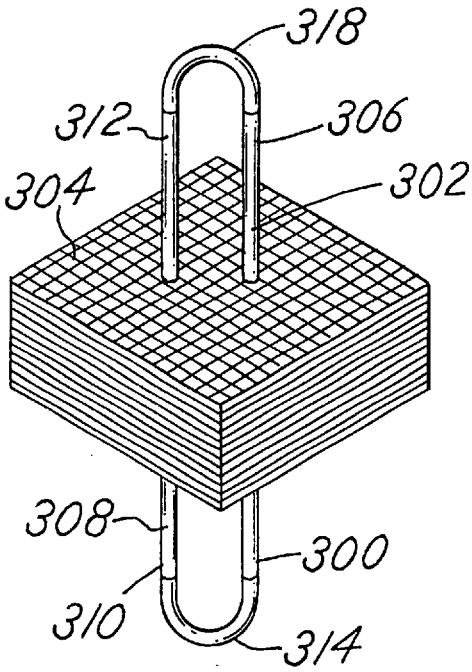
FIG. 13 is another perspective view of multiple fabric anchors, four in number, interconnected and used to secure together a stack of fabric.

In still another use aspect, referring to FIGS. 12 and 13, the male end 300 of a first elongate member 302 can be inserted straight through a stack of fabric portions 304 from topside to emerge on the underside leaving the female end 306 exposed on the topside. Separately, a second elongate member 308 can be similarly inserted at some preselected distance from the first elongate member 302 except that the male end 312 of the second elongate member 308 is inserted from the underside to the topside of the stacked fabric portions 304 leaving the female end 310 exposed on the underside. The exposed female end 306 of the first elongate member can then be aligned with the corresponding male end 312 in axial relationship and fastened thereto. A third elongate member 314 can be employed to fasten to the male end 300 and female end 310 on one side. If desired, the third elongate member 314 can be omitted and male end 300 can be fastened directly to female end 310. Referring to FIG. 13, a fourth elongate member 318 can be employed to fasten to the male end 312 and the female end 306 on the other side.

These use aspects allow the user to remove fabric portions from either the topside or the underside of a stack as desired while keeping the bulk of the fabric anchored. Thus, the inventive fabric anchor gives the user the ability to mix and match elongate members to tailor the size and length of the fabric anchor to accommodate for the initial thickness of the stack of fabrics and adjust for changes in the thickness as fabric portions are removed. Additionally, the user can tailor the strength of the fabric anchor by combining flexible elongate members made of plastic material and elongate members made of less flexible metal wire. For example, elongate members 302 and 308 of FIGS. 12 and 13 can be made of metal wire material and elongate members 314 and 318 can be made of flexible plastic material.

Figure 9:
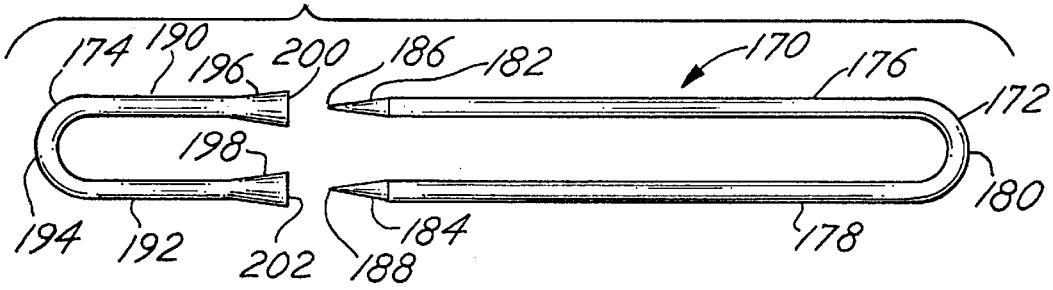
FIG. 9 is a plan exploded view of a seventh preferred embodiment of a fabric anchor of the present invention.
Figure 10:
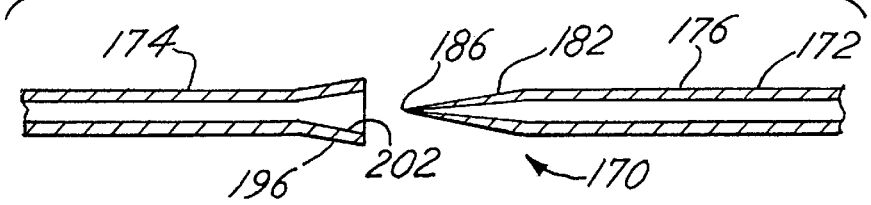
FIG. 10 is an enlarged, longitudinal cross-section of a portion of the fabric anchor of FIG. 9.

FIGS. 9 and 10 show a seventh preferred embodiment of a fabric anchor 170 of the present invention. Turning to FIG. 9, fabric anchor 170 includes a first member 172 and a second member 174. First member 172 is preferred to be somewhat longer than second member 174, although members 172 and 174 can be the same length, or member 174 can be longer than member 172.

First member 172 can comprise a length of hollow metal or plastic tubing that has been bent or molded into a substantially stiff, shape-retaining U-shape to include a first leg 176 and a second leg 178 that are substantially parallel to each other in substantially the same plane. As illustrated, first member 172 is made of metal material, but can be made of plastic material. Legs 176 and 178 are connected by an arcuately curved portion 180. As shown in enlarged view in FIG. 10, the opposite ends of first member 172 are swaged to form tapered portions 182 and 184, each of which terminates in points 186 and 188, respectively. Points 186 and 188 preferably are relatively blunt and rounded to reduce the risk of injury to the wearer, yet are sufficiently sharp to be able to penetrate cloth fabric.

Second member 174, similarly to first member 172, can comprise a length of hollow metal or plastic tubing that has been bent or molded into a substantially stiff, shape-retaining U-shape to include a first leg 190 and a second leg 192 that are substantially parallel to each other in substantially the same plane. Second member 174 as illustrated is made of metal material, but can be made of plastic material. First and second members 172 and 174 can be made of the same or dissimilar materials. For example, first member 172 can be made of metal material and second member 174 can be made of plastic material. Alternatively, first member 172 can be made of a relatively rigid plastic material whereas second member 174 can be made of a relatively flexible plastic material. Yet another example would be first member 172 made of a hard, stiff metal material such as steel alloy, with second member 174 made of a softer metal material such as aluminum.

Legs 190 and 192 are connected by an arcuately curved portion 194. The opposite ends of second member 174 are flared to form conical funnel portions 196 and 198, each of which terminates in flared openings 200 and 202, respectively. The interior surface of the tubing of second member 174 at conical funnel portions 196 and 198 is conically tapered at an angle that is substantially similar to the conical taper of tapered portions 182 and 184 of first member 172. The angle of taper is selected to be sufficiently small, with respect to the material of which first member 172 and second member 174 are constructed, to provide for friction locking engagement of first member 172 and second member 174.

Tapered portions 182 and 184 of first member 172, when inserted into flared portions 196 and 198 of second member 174, respectively, develop sufficient friction with flared portions 196 and 198 to retain first member 172 in engagement with second member 174. When so engaged, moderate axial tension applied in opposing directions to first member 172 and second member 174 will not disengage members 172 and 174 from each other. On the other hand, first member 172 can be withdrawn from second member 174 by applying sufficient axial tension to overcome the friction locking engagement.

Figure 11:
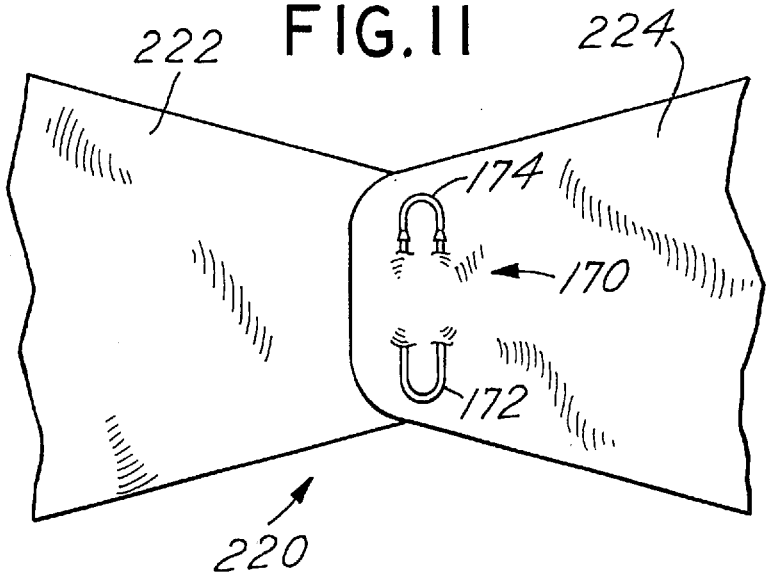
FIG. 11 is a partial view of a garment showing the fabric anchor of FIG. 9 in use, securing at least two portions of fabric together.

FIG. 11 shows a non-limiting example of the manner of using fabric anchor 170 of FIG. 10. A fabric 220 can comprise a cloth diaper, for example, including at least two portions such as first portion 222 and second portion 224 that are to be anchored together temporarily. Portions 222 and 224 are overlapped to close the garment 220 about the waist of an infant, for example. Portions 222 and 224 can be anchored together by grasping first member 172 and inserting the points 186 and 188 simultaneously into portion 224 from the front side and through portion 224 and through portion 222 therebelow, so as to emerge from portion 222 on the back side. The angle of approach is then adjusted so that points 186 and 188 are reinserted into portion 222 from the backside, through portion 222 and through portion 224 thereabove, so as to emerge from portion 224 on the front side, which is the same side that first member 172 penetrated initially. The exposed points 186 and 188 are then covered by aligning second member 174 with first member 172 and fastening members 172 and 174 together by pressing axially such that points 186 and 188 are received in flared portions 200 and 202, respectively. Sufficient axial force is applied to effect a frictional engagement between member 172 and member 174. The points 186 and 188 are thereby covered, further protecting the wearer of the garment from injury, and member 174 is fastened to member 172, which also helps prevent member 172 from slipping out of the fabric of garment 220.

It is preferable to insert member 172 in a direction that is substantially perpendicular to the direction of tension in the portions of the garment being anchored, so that members 222 and 224 pull substantially at right angles to the length of legs 176 and 178 of member 172. Consequently, the garment does not exert a force on fabric anchor 170 that would tend to pull members 172 and 174 apart. When it is desired to open the garment, i.e., separate member 224 from member 222 of garment 220, the user can grasp the arcuate portions 180 and 194, respectively, of members 172 and 174 and pull in opposite axial directions with sufficient force to overcome the frictional engagement between member 172 and member 174 and remove member 174 from member 172. Thereafter, member 172 can be withdrawn axially from both portions 222 and 224 of the garment 220.

As further alternatives, the male and female ends of fabric anchors 60 of FIG. 5, 130 of FIG. 7, 150 of FIG. 8 can be employed in a configuration similar to that of the seventh embodiment of a fabric anchor 170 shown in FIG. 9. In other words, a first member would have a male end on both legs, and a second member would have a female end on both legs.

The fabric anchors of this invention can be manufactured simply and economically of commercially available tubing or rods of light weight plastics, or metal that are extrudable or moldable and into which the tapered male and female ends can be formed or machined. It is recognized that for certain purposes it may be desirable to manufacture the tapered male end of one material, such as metal, and then adhere it to the elongate member having the female end without departing from the principles of this invention.

Although the present invention has been described in detail in terms of preferred embodiments, no limitation of the scope of the invention is intended. The subject matter in which the applicant seeks an exclusive right is defined in the appended claims.

I claim:

1. A self-fastening fabric anchor, comprising:

a flexible elongate anchor member having first and second ends, said first end having an elongate pin extending axially therefrom, and said second end having an axial receptacle therein substantially axially aligned with said flexible elongate anchor member and sized for receiving and retaining said elongate pin in engaging relationship within said receptacle by a friction fit or an interference fit, yet permit said pin to be withdrawn upon application of sufficient disengaging axial tension.

2. The fabric anchor of claim 1, wherein said elongate pin is substantially cylindrical, and said axial receptacle is a substantially cylindrical bore.

3. The fabric anchor of claim 1, wherein said elongate pin is substantially conical, and said axial receptacle is a substantially conical bore.

4. The fabric anchor of claim 1, further comprising a second like flexible elongate anchor member having first and second ends, said first end having an elongate pin extending axially therefrom, and said second end having an axial receptacle therein substantially aligned with said second flexible elongate anchor member;

wherein said elongate pin of each one of said anchor members is received axially and retained in like engaging relationship within said axial receptacle of the other anchor member.

5. The fabric anchors of claim 4, wherein one of said anchor members is greater in length than the other anchor member.

6. The fabric anchors of claim 4, wherein each elongate pin is substantially cylindrical, and each axial receptacle is substantially cylindrical.

7. The fabric anchors of claim 4, wherein each elongate pin is substantially conical, and each axial receptacle is substantially conical.

8. The fabric anchor of claim 1, comprised of metal or plastic material, or combinations thereof.

9. A fabric anchor, comprising:

a first elongate anchor member having first and second ends, said first end having an elongate pin extending axially therefrom, and said second end having an axial receptacle therein;

a second elongate anchor member having first and second ends, said first end having an axial receptacle therein, and said second end having an elongate pin extending axially therefrom;

said first and second elongate anchor members being configurable such that said first and second ends extend generally in a common direction; and said elongate pin of said first anchor member being sized to be received axially in a friction fit or an interference fit within said axial receptacle of said second anchor member;

said elongate pin of said second anchor member being sized to be received axially in a friction fit or an interference fit within said axial receptacle of said first anchor member; and said friction fit or interference fit presenting sufficient friction or interference, respectively, to retain said pin within said receptacle, yet permit said pin to be withdrawn upon application of sufficient axial tension.

10. The fabric anchor of claim 9, wherein at least one of said elongate pins is substantially cylindrical, and at least one of said axial receptacles is substantially cylindrical.

11. The fabric anchor of claim 9, wherein at least one of said elongate pins is substantially conical, and at least one of said axial receptacles is substantially conical.

12. The fabric anchor of claim 9, wherein one of said anchor members is greater in length than the other anchor member.

13. The fabric anchor of claim 9, comprised of metal or plastic material, or combinations thereof.

14. A fabric anchor, comprising:

a first elongate anchor member having first and second ends, each one of said first end and said second end having an elongate pin extending axially therefrom;

a second elongate anchor member having first and second ends, each one of said first. end and said second end having an axial receptacle therein substantially axially aligned with said second elongate anchor member;

said first and second elongate anchor members being configurable such that said first and second ends of each respective anchor member extend generally in a common direction;

each of said elongate pins of said first anchor member being sized to be received axially in a friction fit or an interference fit within a respective one of said axial receptacles of said second anchor member; and said friction fit or interference fit presenting sufficient friction or interference, respectively, to retain said pin within said receptacle, yet permit said pin to be withdrawn from said receptacle upon application of sufficient axial tension.

15. The fabric anchor of claim 14, wherein at least one of said elongate pins is substantially cylindrical, and at least one of said respective axial receptacles is substantially cylindrical.

16. The fabric anchor of claim 14, wherein at least one of said elongate pins is substantially conical, and at least one of said respective axial receptacles is substantially conical.

17. The fabric anchor of claim 14, wherein one of said anchor members is greater in length than the other anchor member.

18. The fabric anchor of claim 14, comprised of metal or plastic material, or combinations thereof.

19. A fabric anchor, comprising:

a flexible elongate anchor member having first and second ends, said first end having an elongate pin extending axially therefrom, and said second end having a longitudinal slot therein;

said elongate pin of said anchor member being sized and configured to be received axially in an interference fit within said longitudinal slot of said anchor member; and said interference fit presenting sufficient interference to retain said pin within said slot, yet permit said pin to be withdrawn upon application of sufficient axial tension.

20. The fabric anchor of claim 19, further comprising a second like flexible elongate anchor member having first and second ends, said first end having an elongate pin extending axially therefrom, and said second end having a longitudinal slot therein;

wherein said elongate pin of each one of said anchor members is received axially in an interference fit within said longitudinal slot of the other anchor member.

21. The fabric anchor of claim 19, wherein said elongate pin of said anchor member is toothed externally and said longitudinal slot is toothed internally; and said external teeth of said pin being engageable with said internal teeth of said longitudinal slot to retain said pin within said slot, yet being disengageable to permit said pin to be withdrawn from said second end.

22. A fabric anchor, comprising:

a first elongate anchor member having first and second ends, said first end having an elongate pin extending axially therefrom, and said second end having a longitudinal slot therein;

a second elongate anchor member having first and second ends, said first end having a longitudinal slot therein, and said second end having an elongate pin extending axially therefrom;

said first and second elongate anchor members being configurable such that said first and second ends extend generally in a common direction;

said elongate pin of said first anchor member being sized to be received axially in an interference fit within said longitudinal slot of said second anchor member;

said elongate pin of said second anchor member being sized to be received axially in an interference fit within said longitudinal slot of said first anchor member; and said interference fit presenting sufficient interference to retain said pin within said slot, yet permit said pin to be withdrawn upon application of sufficient axial tension.

23. The fabric anchor of claim 22, wherein each elongate pin of said anchor member is toothed externally and each longitudinal slot of said anchor member is toothed internally; and said external teeth of said pin being engageable with said internal teeth of said longitudinal slot to retain said pin within said slot, yet being disengageable to permit said pin to be withdrawn from said slot.

24. A fabric anchor, comprising:

at least one elongate anchor member having first and second ends, said first end having a male portion and said second end having a female portion defined therein substantially axially aligned with said elongate anchor member and sized to axially receive and retain a male portion in mutually engaging relationship until application of sufficient disengaging axial tension to said male and female portions.

25. A method of temporarily anchoring at least two selected fabric portions together, comprising the steps of:

providing at least two superposed fabric portions;

providing a fabric anchor having at least one flexible elongate anchor member comprising a first and second end, said first end having an elongate pin extending axially therefrom, and said second end having an axial receptacle therein substantially axially aligned with said flexible elongate anchor member and sized for receiving and retaining an elongate pin therein in a friction fit or an interference fit;

inserting the elongate pin into and through one side of the selected fabric portions at a selected insertion point to emerge from the opposite side, thereby capturing the fabric portions; and aligning a selected pin with a selected axial receptacle and pressing axially such that the pin is received in the axial receptacle and retained therein until sufficient opposing axial force is applied to disengage step in from the axial receptacle.

26. The method of claim 25, and further comprising the step of:

re-inserting the elongate pin into and through the opposite side of the captured fabric portions to re-emerge from the one side at a distance from the insertion point.

27. A method of temporarily anchoring at least two selected fabric portions together, comprising the steps of:

a) providing at least two superposed fabric portions;

b) providing a fabric anchor comprising a first elongate anchor member having first and second ends, each one of said first end and said second end having an elongate pin extending axially therefrom;

a second elongate anchor member having first and second ends, each one of said first end and said second end having an axial receptacle therein substantially axially aligned with said second elongate anchor member;

said first and second elongate anchor members being configurable such that said first and second ends extend generally in a commnon direction; and each of said elongate pins of said first anchor member being sized to be received axially in a friction fit or an interference fit within a respective one of said axial receptacles of said second anchor member;

c) inserting the first anchor member into and through one side of the selected fabric portions at an insertion point to emerge from the opposite side thereby capturing the superposed fabric portions;

d) re-inserting the first anchor member into and back through the captured fabric portions so as to emerge from the one side at a distance from the insertion point; and e) aligning each pin of the first anchor member with an axial receptacle of the second anchor member and pressing axially such that each of the pins of the first anchor member are received in a respective axial receptacle of the second anchor member and retained in engaging relationship therein until sufficient axial tension is applied to disengage the pins from the axial receptacles.

28. A method of temporarily anchoring a stack of fabrics together comprising the steps of:

a) providing a stack of fabrics presenting a topside and underside;

b) providing at least three elongate anchor members, each having a first end and a second end, where the first end comprises an elongate pin extending axially therefrom and the second end comprises an axial receptacle therein sized for receiving and retaining an elongate pin in engaging relationship, such as by friction or interference fit, within the axial bore until sufficient axial tension is applied to disengage the elongate pin from the axial bore;

c) inserting the first end of a first elongate member into the topside of the stack and through the stack to emerge on the underside of the stack, such that the second end of the first elongate member remains exposed on the topside;

d) inserting the first end of a second elongate member into the underside of the stack and through the stack to emerge at a distance from the first elongate member, such that the second end of the second elongate member remains exposed on the underside;

e) aligning the emergent first end of the first elongate member with the second end of a third elongate member and pressing axially until engaging relationship is obtained;

f) aligning the exposed second end of the second elongate member with the first end of the third elongate member and pressing axially until engaging relationship is obtained; and g) aligning the exposed second end of the first elongate member with the emergent first end of the second elongate member and pressing axially until engaging relationship is obtained such that the stack of fabric is anchored until sufficient axial tension is applied to a first and second end of a selected elongate member to disengage an elongate pin from an axial receptacle.

29. A method of temporarily anchoring a stack of fabrics together comprising the steps of:

a) providing a stack of fabrics presenting a topside and underside;

b) providing at least four elongate anchor members, each having a first end and a second end, where the first end comprises an elongate pin extending axially therefrom and second end comprises an axial receptacle therein sized for receiving and retaining an elongate pin in engaging relationship, such as by friction or interference fit, within the axial bore, until sufficient axial tension is applied to disengage the elongate pin from the axial bore;

c) inserting the first end of a first elongate member into the topside of the stack and through the stack to emerge on the underside of the stack, such that the second end of the first elongate member remains exposed on the topside;

d) inserting the first end of a second elongate member into the underside of the stack and through the stack to emerge at a distance from the first elongate member, such that the second end of the second elongate member remains exposed on the underside;

e) aligning the emergent first end of the first elongate member with the second end of a third elongate member and pressing axially until engaging relationship is obtained;

f) aligning the exposed second end of the second elongate member with the first end of the third elongate member and pressing axially until engaging relationship is obtained;

g) aligning the exposed second end of the first elongate member with the first end of a fourth elongate member and pressing axially until engaging relationship is obtained; and h) aligning the emergent first end of the second elongate member with the second end of the fourth elongate member and pressing axially until engaging relationship is obtained, such that the stack of fabric is anchored until sufficient axial tension is applied to a first and second end of a selected elongate member to disengage an elongate pin from an axial receptacle.

* * * * *

UNITED STATES PATENT AND TRADEMARK OFFICE

CERTIFICATE OF CORRECTION

PATENT NO. : 6,470,541 B1
DATED : October 29, 2002
INVENTOR(S) : Louis L. Lerner It is certified that error appears in the above-identified patent and that said Letters Patent is hereby corrected as shown below:

Title page,
Item [76], Inventor, change "The Lerner Group, P.O. Box 10601, Chicago, IL (US) 60610-0601" to -- 900 Lake Shore Drive, Chicago, IL (US) 60611 --.

Column 13,
Line 23, delete the period character "." after the word "first".

Column 15,
Line 2, change "step in" to -- the pin --.

Column 16,
Line 31, delete the period character "." after the word "bore".

Signed and Sealed this

Nineteenth Day of August, 2003

JAMES E. ROGAN
*Director of the United States Patent and Trademark Office*